US006075188A

United States Patent [19]

Wetzlinger et al.

[11] Patent Number: 6,075,188

[45] Date of Patent: Jun. 13, 2000

[54] STICK FOR A STRING INSTRUMENT BOW AND PROCESSES FOR ITS PRODUCTION

[76] Inventors: Andreas Wetzlinger, Seegasse 5/12, A-1090 Vienna, Austria; Bernd Müsing, Am Holzweg 10, D-97222 Rimpar, Germany

[21] Appl. No.: 09/214,400

[22] PCT Filed: Jul. 1, 1997

[86] PCT No.: PCT/AT97/00148

§ 371 Date: Jun. 2, 1999

§ 102(e) Date: Jun. 2, 1999

[87] PCT Pub. No.: WO98/01846

PCT Pub. Date: Jan. 15, 1998

[30] Foreign Application Priority Data

Jul. 3, 1996 [AT] Austria ..... 1180/96

[51] Int. Cl.[7] ..... G10D 1/02

[52] U.S. Cl. ..... 84/282; 84/274

[58] Field of Search ..... 84/282, 274

[56] References Cited

U.S. PATENT DOCUMENTS

| | | | |
|---|---|---|---|
| 2,487,442 | 11/1949 | Hohl | 84/282 |
| 4,754,681 | 7/1988 | Maigret et al. | 84/282 |

FOREIGN PATENT DOCUMENTS

| | | |
|---|---|---|
| 062973 | 10/1982 | European Pat. Off. . |
| 386228 | 6/1908 | France . |
| 874670 | 8/1942 | France . |
| 976308 | 3/1951 | France . |
| 85912 | 2/1895 | Germany . |
| 4014894 | 11/1990 | Germany . |
| WO8402792 | 7/1984 | WIPO . |

*Primary Examiner*—David S. Martin
*Assistant Examiner*—Shih-yung Hsieh
*Attorney, Agent, or Firm*—Abelman, Frayne & Schwab

[57] ABSTRACT

In a stick (1) for a string instrument bow, comprising fiber-reinforced synthetic material and adapted for receiving a frog and for attaching hair thereto, the product of the mass of the stick (1) alone, in g, times the deflection (D) of the stick alone, which constitutes a measure of the stiffness, in mm, when the stick (1) is supported in its handle region at the stick end (at 3) on the outer side opposite the hair side and at a distance of 130 mm therefrom (at 4) on the hair side or inner side, and when a force (F) acts on the head end (5) corresponding to a mass of 300 g, is, for a violin and viola bow 1000 mm.g at the most, preferably 800 mm.g, for a violoncello bow 700 mm.g at the most, preferably 550 mm.g at the most, and for a double-bass bow 600 mm.g at the most, preferably 450 mm.g at the most, so as to obtain a light-weight, stiff bow for a modified playing technique.

23 Claims, 2 Drawing Sheets

STICK FOR A STRING INSTRUMENT BOW AND PROCESSES FOR ITS PRODUCTION

BACKGROUND OF THE INVENTION

The invention relates to a stick for a string instrument bow, comprising fiber-reinforced synthetic material and adapted for receiving a frog and for attaching hair thereto.

Furthermore, the invention relates to a method of manufacturing such a stick for a string instrument bow.

Usually, bow sticks, including the head, for bows of string instruments are made of fernambuco wood; these selected wood pieces must be stored and dried flawlessly for long periods of time, before the respective bow stick is made, at the making of which the distribution of weight, the position of the center of gravity and the resilience are important. To the bow stick, a tensioning device for bow hair called frog as well as the hair (i.e. the hair of the bow) are attached to complete the bow.

Lately, in view of the restrictions regarding the recovery of wood pieces for string instrument bows as well as of the time consuming and expensive preparation of bows from these wood pieces, suggestions for utilizing more recent manufacturing technologies have already been published wherein for the bow stick particularly fiber-reinforced synthetic material, such as carbon fiber materials, optionally using an internal stick core of a light-weight material, such as particularly balsa wood, should be employed, cf., e.g., WO 84/02792 and DE 40 14 894 A1. Even though at these known bow sticks an adaptation of e.g. the strength or sound propagation properties has been desired to a certain extent by the material selection, wherein also, other than with wooden sticks, a reproducibility should be ensured, it has nevertheless been attempted to achieve properties for the bow stick made of synthetic material as similar as possible to those of bow sticks made of wood. This also applies to the bow according to WO 92/09068 whose stick is substantially formed by a hollow synthetic material stick in which there is housed a tensioning element capable of being biased by a threaded screw. By this the bow can be biased in the interior of the stick in parallel to the tension caused by the hair, by which, however, necessarily also the curvature of the stick will change with the bias which, however, may be detrimental for playing when the hair is pressed onto the strings of the string instrument.

The idea forming the basis of the present invention is to provide a bow whose properties are different from those of conventional bows, which allows for new playing techniques, instead of imitating the conventional wooden bow or of attaining, with the new material, properties as similar to those of the former as possible. It must be taken into consideration that, as tests and measurements have shown, in conventional bows, usually the stiffness of the respective bow stick is to be chosen approximately proportional to the weight of the stick so that the quotient from weight and stiffness will remain approximately equal for bows (or, more exactly, bow sticks) of different weight.

In the tests which have led to the present invention, the deformation, i.e. deflection, according to the following conditions has been chosen as a measure for the stiffness of the bow sticks. The respective bow stick—still without hair and frog thereon—at its handle end is clamped at its outer side as well as at a distance of 130 mm therefrom at its inner side. A force corresponding to a weight load of 300 g is then exerted at the head end; accordingly, the bow stick is downwardly deflected or bent, and this deformation or deflection is measured and used as a measure for the stiffness of the bow stick.

For conventional violin bows and viola bows, there resulted the following values according to Table 1, and it is apparent that comparable product values (i.e. for bows of the same type) are always relatively close.

TABLE 1

| | | Weight of the Stick [g] | Deflection [mm] | Deflection × Weight [mm.g] |
|---|---|---|---|---|
| Violin bow, | light | 33 | 42 | 1386 |
| | normal | 39 | 35 | 1365 |
| | heavy | 45 | 28 | 1260 |
| Viola bow, | light | 40 | 33 | 1320 |
| | normal | 43 | 30 | 1290 |
| | heavy | 47 | 26 | 1222 |

Similar results could be found for conventional violoncello bows as well as for double-bass bows, cf. Table 2.

TABLE 2

| | | Weight of the Stick [g] | Deflection [mm] | Deflection × Weight [mm.g] |
|---|---|---|---|---|
| Violoncello bow, | light | 45 | 27 | 1215 |
| | normal | 52 | 19 | 988 |
| | heavy | 57 | 17 | 969 |
| Double-bass bow, | light | 57 | 16.5 | 940.5 |
| | normal | 65 | 14 | 910 |
| | heavy | 85 | 10 | 850 |

The test length of the individual bow sticks was a common stick length and was 70 cm for the violin bow, 69 cm for the viola bow, 66 cm for the violoncello bow and 64 cm for the double-bass bow.

From preceding Tables 1 and 2 it is apparent that the stick of known bows is the stiffer, the more massive the bow stick, a high stiffness of the bow being desired for many playing techniques, yet this should not be associated with a correspondingly high mass of the bow; the high mass, and the high weight of the bow, respectively, do mean a certain moment of inertia which is detrimental when changing the direction of stroke and in bouncing bow techniques. A light-weight bow in turn, however, is relatively flexible, i.e. it has a relatively pronounced deflection, and with a high bow pressure required for obtaining a higher sound volume, this deflection will lead to a contact of string, hair and bow stick and thus give rise to very unpleasant secondary noises.

SUMMARY OF THE INVENTION

In detail, it is thus an object of the invention to provide a bow stick which is as light-weight as possible yet which nevertheless is stiff and which allows for an improved play, particularly when using the bouncing bow techniques, by doing away with the mode of construction employed so far for string instrument bows. According to the above-mentioned test results, the product of the mass of the bow stick times the deflection, as defined before, has proven suitable as a measure therefor, since this is a very characteristic parameter.

Accordingly, in the inventive bow stick of the initially defined type it is provided that the product of the mass of the stick alone, in g (gramm), times the deflection of the stick alone, which constitutes a measure of the stiffness, in mm (millimeter), when the stick is supported in the handle region at the stick end on the outer side opposite the hair side and at a distance of 130 mm therefrom on the oppositely located hair or inner side, and when a force acts on the head end corresponding to a mass of 300 g, is, for a violin or viola bow 1000 mm.g at the most, preferably 800 mm.g at the most, for a violoncello bow 700 mm.g at the most, preferably 550 mm.g at the most, and for a double-bass bow 600 mm.g at the most, preferably 450 mm.g at the most. For the new playing modes sought it has proven particularly suitable if the product of mass times deflection of the stick for a violin and viola bow is 600 mm.g at the most, preferably approximately 450 to 500 mm.g, for a cello bow 400 mm.g at the most, preferably approximately 300 mm.g, and for a double-bass bow 350 mm.g at the most, preferably approximately 250 mm.g.

With the present bow stick, the object set out above is met in an advantageous manner, and due to the low mass given on account of the product values indicated, light and quick playing is made possible which is also comparatively little tiring. On the other hand, the slighter deflection, or higher stiffness, respectively, makes it possible to touch down with the bow more strongly, and on account of the higher stiffness of the bow stick the bow stick will not be completely bent through even at a slight bias of the hair, and a contact string/hair/bow stick will not occur. In detail, it is to be noted that bouncing bow techniques can best be carried out if the bow used has a low weight and the hair is only slightly biassed. Loud play, on the other hand, requires a high bias of the hair and thus a relatively stiff bow which in conventional embodiments is relatively heavy and inert.

For this reason, usually as good a compromise as possible is sought, and the player will bias the bow to various degrees, depending on the playing techniques required for performing a certain piece of music.

Beside a low weight, the bows comprising the stick according to the invention are primarily characterized in that it is always possible to play with a favorable bias from the point of view of playing technique (a relatively low bias) so that bouncing bow techniques are easy to perform, yet due to the high stiffness, nevertheless there will be no bow stick/hair/string contact during a forte-legato play.

As has been mentioned, the bow stick according to the invention is leight weight, on the one hand, yet stiff, on the other hand, and the above-indicated product of mass times deflection is a good basis for dimensioning the bow sticks. The specific design of the respective bow stick may be found without any problems by the person skilled in the art of plastics technology on the basis of the given or desired final properties (mass, stiffness), in particular by choosing suitable materials and amounts thereof to be used. With a view to the sought light-weight configuration it is particularly advantageous if the mass of the stick alone is 30 g at the most for a violin and viola bow, 40 g at the most for a violoncello bow, and 50 g at the most for a double-bass bow. On the other hand, with a view to the sought particularly stiff configuration it is suitable if the deflection of the stick is 25 mm at the most for a violin and viola bow, 15 mm at the most for a violoncello bow, and 9 mm at the most for a double-bass bow.

To obtain the sought light-weight yet stiff configuration of the stick, it has also proven advantageous if at least two layers of fiber-reinforced synthetic material, preferably with divergent fiber directions, are arranged around an elongate core made, e.g., of balsa wood or of foamed material.

For biassing the hair, furthermore a stable connection of head and stick body proper is important, and in this context it is also suitable if the head is made of at least one layer of fiber-reinforced synthetic material folded around the fiber-reinforced synthetic material at the end of the stick proper. To save weight, it is furthermore advantageous if the folded-around synthetic material layer of the head encloses a cavity which optionally is filled with a light-weight material, such as a foamed material. The cavity within the head may, however, also be left empty. The layer of fiber-reinforced synthetic material of the head folded around the synthetic material of the stick end gives a sufficient compressive strength also if the cavity is empty, apart from the attained extremely solid, stable connection with the synthetic material of the stick body.

For attaching the hair to a bow stick, usually on the head, a wedge is inserted in a corresponding receiving space, and for the present stick, such a receiving space could be worked into the head when the bow stick has been finished. A head coating, such as a platelet of ivory, could be glued to the head on the hair side. However, the construction described allows for a composite structure with pre-fabricated parts in an advantageous manner, and in this connection it is thus particularly suitable if the folded-around synthetic material layer of the head is fixedly connected with an insert provided on the hair side, leaving free a receiving space for a wedge for fastening the hair. The insert may simply contain the receiving space. In this manner, the manufacturing step of the laying around of the fiber-reinforced synthetic material layer for the head is additionally simplified.

With the present construction of the stick, for attaching the tensioning device to the bow stick, it is furthermore suitable if a bearing insert preferably made of synthetic material is arranged at the handle end of the stick as a continuation of the core in the longitudinal direction of the stick and with continued synthetic material layers being wound therearound, a lateral, slit-shaped aperture for fastening of a frog being left free both in the synthetic material and in the bearing insert.

When manufacturing the present stick for a string instrument bow, it is advantageously proceeded such that around an elongate core of a light-weight material having the mass suitable for the stick to be made, e.g. of foamed material or of balsa wood, at least two layers of fiber-reinforced synthetic material are laid, and that prior to the curing of this synthetic material, at least one layer of fiber-reinforced synthetic material, optionally including a head core of light-weight material, is laid around the head-side end of the stick proper so as to form the head, whereupon the synthetic material of the stick including the head is cured in a mould. In this manner an extremely stable composite can be obtained by applying simple manufacturing steps so that the desired high stiffness of the bow stick of the invention is easily possible while a low mass is attained. For attaching the head by using an insert forming a cover when the head has been finished, it is suitable if the synthetic material of the head when being laid in is pressed against a pre-fabricated synthetic material insert and is fixedly connected thereto during curing.

BRIEF DESCRIPTION OF THE DRAWING

The invention will now be further explained by way of preferred exemplary embodiments to which, however, it shall not be restricted, and with reference to the accompanying drawings. In detail, in the drawings FIG. 1 schematically shows a test arrangement for sticks of string instrument bows so as to determine their deflection as a measure for the stiffness under reproducible conditions.

DETAILED DESCRIPTION OF THE PREFERRED EMBODIMENT

Figure 1:
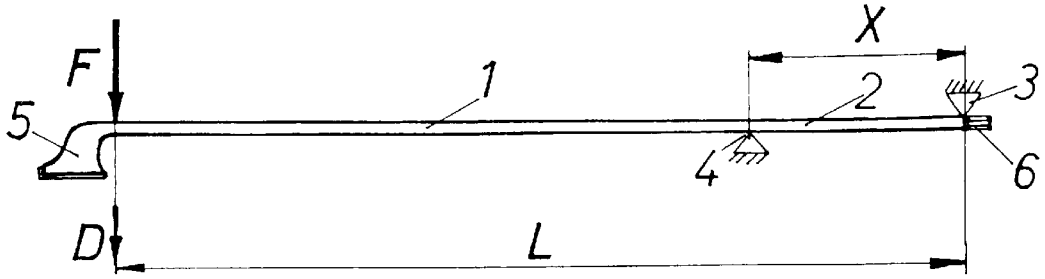

FIG. 1 schematically shows an arrangement with which—as has already been mentioned—conventional bow sticks, yet also bow sticks formed according to the invention were tested for their stiffness. In detail, in the arrangement according to FIG. 1, the respective bow stick 1—still without hair and frog—is fixed at the handle end 2 at its outer side, at 3, as well as at a distance of x=130 mm therefrom at its inner side, at 4; a force F corresponding to a weight load of 300 g is then exerted on the thus braced bow stick 1, on the head end 5 thereof. By this, the bow stick 1 makes a downward deflection or is bent downwardly, cf. the downwardly directed arrow in FIG. 1, and this deformation or deflection D is measured and used as a measure of the stiffness of the bow stick 1. On the handle end 2, moreover a front-side support 6 is shown in FIG. 1 to safeguard against longitudinal shifting.

The corresponding values for the conventional bow sticks have already previously been indicated in Tables 1 and 2; in the following more detailed reference will be made to the values obtained with the bow sticks designed according to the invention.

Figure 2:
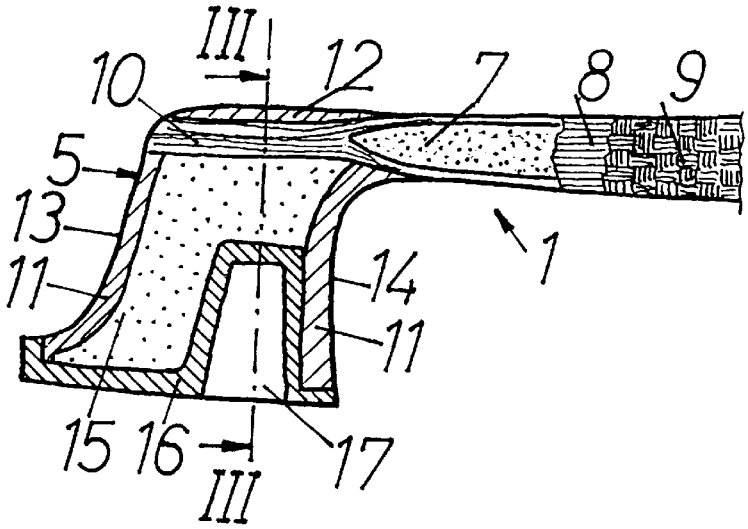
FIG. 2 in a partially sectioned view shows the head end of the bow stick according to the invention.
Figure 3:
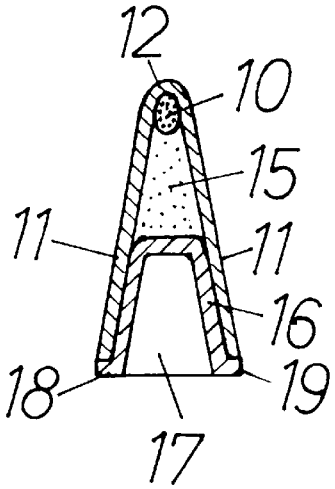
FIG. 3 shows a cross-section through this head end, according to line III—III in FIG. 2.
Figure 4:
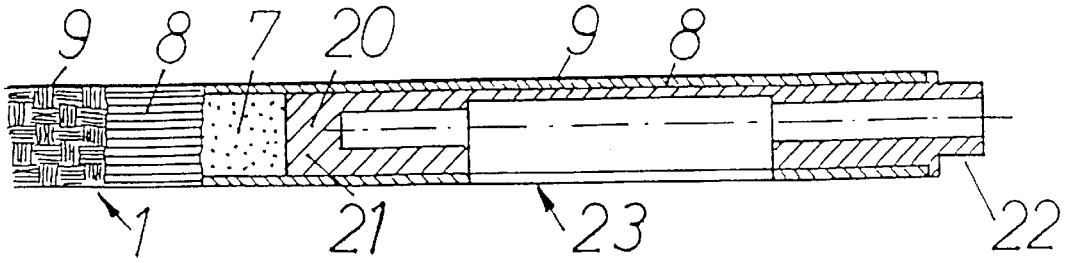
FIG. 4 in a partially sectioned view shows the handle end of the bow stick, e.g., according to FIGS. 2 and 3, to illustrate the bearing insert for the attachment of a frog (not illustrated)

In FIGS. 2 and 3, the head end 5 of a bow stick 1 for a bow of a string instrument is shown. The handle end of this bow stick 1 is shown in FIG. 4. The remaining stick body not illustrated in detail is formed as immediately results from FIGS. 2 and 4, i.e. with a light-weight core 7 of balsa wood or foamed synthetic material, around which as the fiber-reinforced synthetic material, a uni-directionally oriented carbon laminate 8 (so-called UD carbon laminate) is arranged as a first layer, around which a carbon fiber fabric 9 is arranged as a second layer for obtaining a high compressive strength. The UD carbon laminate 8 unites at the head end 5, in front of the core 7 ending there, as is apparent from FIG. 2. To make the head 5, a prepared layer of fiber-reinforced synthetic material, i.e. again a carbon laminate 11 of approximately twice the size of the head is folded around the thus-obtained end 10 of the stick body of approximately oval cross-section (cf. FIG. 3)—with the exception of the back 12, cf. also FIG. 3, additional carbon material being provided at 13 and 14, respectively, at the front side and at the rear side of the head 5 so as to define a chamber or a cavity 15. This cavity 15 may remain empty, or it may be filled with a foamed material, as is schematically illustrated in the present exemplary embodiment.

For manufacturing purposes it is furthermore suitable if on the side of the head 5 facing the hair (not illustrated in detail) to be fastened, the hair side, an insert 16 is mounted with which the carbon laminate 11 is fixedly connected during the manufacturing process; this insert 16 may be made of synthetic material (fake ivory). As such, this insert 16 may also be glued in after manufacture of the head 5.

In the embodiment according to FIGS. 2 and 3, the synthetic material insert 16 furthermore defines an inwardly narrowing receiving space 17 for a wedge (not illustrated), as is common per se and used for attaching the hair. As is furthermore apparent from the sectional representation of FIG. 3, the synthetic material insert 16 has lateral flanges 18, 19 on which the carbon laminate layer 11 comes to abut so as to additionally strengthen the stable composite body, or the connection between insert 16 and carbon laminate layer 11, apart from a favorable optical impression.

According to FIG. 4, a bearing insert 20, preferably a pre-fabricated part of synthetic material, follows upon the core 7 at the handle end of the bow stick 1. This bearing insert 20 is generally tubular, with a closed front end 21 and an open rear end 22 for introducing a per se conventional screw (not illustrated in detail) in the longitudinal direction from the rear end 22. On the side of the stick 1 facing the hair (inner side), at 23 a longitudinal slit is left free in the bearing insert 20, and likewise in the carbon fiber material layers 8, 9 surrounding the latter as well as in the bearing insert 20 itself, through which a tensioning device, called frog, for the hair can be inserted before the spindle is screwed in. By aid of this screw, this frog which has a corresponding internal thread matching the thread of the screw spindle can be longitudinally displaced in the slot 23 in longitudinal direction of the stick so as to tension the hair to a greater or slighter degree. These components are conventional per se and of no further interest to the present invention so that they need not be illustrated in the drawings.

Figure 5:
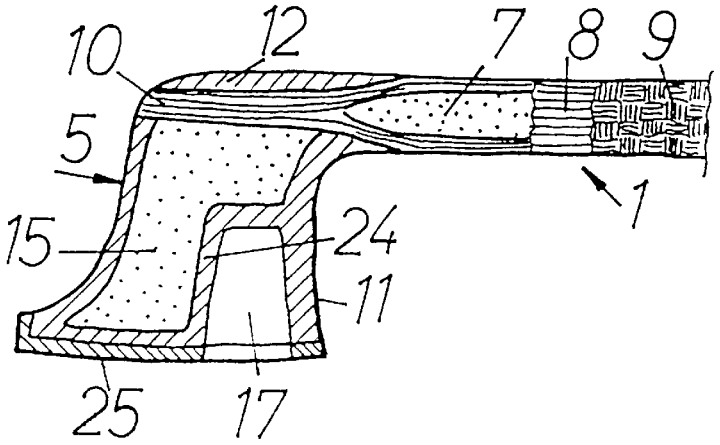
FIG. 5 shows a modified embodiment of the head of a bow stick in a representation similar to FIG. 2.

In the embodiment according to FIG. 5, different from that according to FIG. 2, the carbon fiber material 11 is also used for forming the receiving space 17 for the wedge, as is apparent at 24 in FIG. 5. This form of the head 5 is preferably obtained in that a wedge-shaped part (not illustrated) is inserted at the site of the receiving space 17 when the carbon fiber material layer(s) 11 is (are) laid around (cf. FIG. 3), the carbon fiber material 11 being pressed around this wedge-shaped part before the former is cured. This wedge-shaped part is removed again after curing of the bow stick 1 including the head 5 so that the receiving space 17 will remain there. Accordingly, in this embodiment also a simplified synthetic material insert or a synthetic material cover 25 (fake ivory, tortoise shell or the like) is arranged.

When manufacturing the bow stick 1 described, it is proceeded such that at first the UD carbon laminate layer 8 is attached around the light-weight material core 7, this layer 8 being pressed together to obtain the end 10 at the front stick end where there is not any core 7 any more. In the region of the stick body proper, furthermore a carbon fabric having longitudinally and transversely oriented fibers is wound around as layer 9. Before these layers 8, 9 are cured, at the head end 5, the head is formed from one or several carbon laminate layer(s) 11 with the synthetic material insert 16 or 25, respectively, being provided against which the carbon laminate is pressed, as well as optionally with a foamed material filling being provided in the cavity 15. The thus obtained stick structure including the head 5 is then cured in a mould (not illustrated), e.g. by heating to a temperature of between 110° C. and 150° C. (depending on the synthetic resin used).

As the UD material for layer 8, e.g. a carbon fiber material 240 g/m$^2$ may be used, as the fabric material for layer 9 a material having a mass of 100 g/m$^2$ in longitudinal direction and of 100 g/m$^2$ in transverse direction may be used. In addition, there may be a resin content (e.g. epoxy resin) of 42%.

Of course, instead of the carbon fiber material described, also other per se conventional materials may be used as the fiber-reinforced synthetic materials, such as glass-fiber reinforced synthetic materials or also polyamide or polyimide fiber materials having a suitable resin impregnation. Likewise, combinations of the afore-mentioned materials can be used to produce the fiber composite bow stick described.

For test purposes, different bow sticks for violin, viola, violoncello and double-bass were manufactured of carbon fiber material with a balsa wood core 7, as described above, and tested with regard to their deflection D by aid of an arrangement according to FIG. 1. On the whole it showed that the mass of the thus manufactured fiber material bow sticks was from 21 g to 25 g, and the deflection D was in the order of from 8 mm to 25 mm. The progenerally mass times deflection was generally between 250 mm.g and 600 mm.g.

In detail, bow sticks were obtained for double-bass bows in which the above-indicated product was determined to be 250 mm.g; for sticks manufactured for violoncello bows, a product of 300 mm.g was determined; furthermore, the product values for the sticks for a viola bow were 450 mm.g and for a violin bow, 500 mm.g. Depending on the thickness of the carbon fiber material layers 8, 9 as well as, of course, on their weight, the weight of the stick as well as its stiffness can be dimensioned according to the goals envisoned for the string instrument bow to be produced.

When playing with these bows, handling proved to be substantially more easy, in particular when using the bouncing bow techniques. Also, a comparatively slight bias of the hair and of the stick, respectively, was sufficient to nevertheless safely avoid pressing through the hair, even with high bow pressures.

What is claimed is:

1. A stick for a bow of a string instrument, comprising a fiber-reinforced synthetic material and adapted for receiving a frog and for attaching hair to said stick, said stick having a head end, a hair or inner side, an oppositely located outer side, and a stick end including a handle region, said stick having a certain mass measured in g, wherein, when said stick is supported at a first supporting site in said handle region on said stick end on said outer side of said stick and at a second supporting site located on said hair or inner side of said stick, at a distance of 130 mm from said first supporting site, and when a force corresponding to a mass of 300 g acts on said head end of said stick, a deflection results which is measured in mm, said deflection forming a measure for the stiffness of said stick, the product of the mass of the stick alone, in g, times the deflection of the stick alone, in mm, being 1000 mm.g at the most for a violin or viola bow, 700 mm.g at the most for a violoncello bow, and 600 mm.g at the most for a double-bass bow.

2. A stick as set forth in claim 1, wherein said product of said mass times said deflection of said stick is 800 mm.g at the most for a violin or viola bow, 550 mm.g at the most for a violoncello bow, and 450 mm.g at the most for a double-bass bow.

3. A stick as set forth in claim 1, wherein said product of said mass times said deflection of said stick is 600 mm.g at the most for a violin or viola bow, 400 mm.g at the most for a violoncello bow, and 350 mm.g at the most for a double-bass bow.

4. A stick as set forth in claim 1, wherein said product of said mass times said deflection of said stick is approximately 450 to 500 mm.g for a violin or viola bow, approximately 300 mm.g for a violoncello bow, and approximately 250 mm.g for a double-bass bow.

5. A stick as set forth in claim 1, wherein said mass of said stick alone is 30 g at the most for a violin or viola bow, 40 g at the most for a violoncello bow, and 50 g at the most for a double-bass bow.

6. A stick as set forth in claim 1, wherein said deflection (D) of said stick is 25 mm at the most for a violin or viola bow, 15 mm at the most for a violoncello bow, and 9 mm at the most for a double-bass bow.

7. A stick as set forth in claim 1, further comprising an elongate core, at least two layers of said fiber-reinforced synthetic material being arranged around said core.

8. A stick as set forth in claim 7, wherein said core is balsa wood.

9. A stick as set forth in claim 7, wherein said core is made of a foamed material.

10. A stick as set forth in claim 7, wherein said at least two layers of fiber-reinforced synthetic material are arranged such that the fibers extend in different directions.

11. A stick as set forth in claim 7, further comprising a bearing insert arranged at said handle end of said stick in continuation of said elongate core in longitudinal direction of said stick, said at least two layers of said fiber-reinforced synthetic material arranged around said core being continuously wound around said bearing insert, a lateral, slit-shaped aperture for fastening said frog being left tree in said at least two layers of fiber-reinforced synthetic material and in said bearing insert.

12. A stick as set forth in claim 11, wherein said bearing insert is made of synthetic material.

13. A stick as set forth in claim 3, wherein said head comprises at least one layer of fiber-reinforced synthetic material folded around said fiber-reinforced synthetic material at the end of the stick proper.

14. A stick as set forth in claim 13, wherein said folded around at least one layer of fiber-reinforced synthetic material of said head encloses a cavity.

15. A stick as set forth in claim 14, wherein said cavity is filled with a light-weight material.

16. A stick as set forth in claim 15, wherein said light-weight material is a foamed material.

17. A stick as set forth in claim 13, further comprising an insert provided at the hair or inner side of said stick, said folded around at least one layer of fiber-reinforced synthetic material of said head being fixedly connected with said insert by leaving free a receiving space for a wedge for fastening said hair to said stick.

18. A stick as set forth in claim 17, wherein said insert contains said receiving space.

19. A method of manufacturing a stick for a bow of a string instrument, said stick being adapted to receive a frog and to attach hair to said stick and having a head end, a hair or inner side, an oppositely located outer side, and a stick end including a handle region, and said stick having a certain mass measured in g and a certain deflection measured in mm, when said stick is supported at a first supporting site in said handle region on said stick end on said outer side of said stick and at a second supporting site located on said hair or inner side of said stick, at a distance of 130 mm from said first supporting site, and when a force corresponding to a mass of 300 g acts on said head end of said stick, said deflection forming a measure for the stiffness of said stick, said method comprising providing an elongate core of light-weight material having a mass suitable for said stick to be manufactured, laying at least two layers of fiber-reinforced synthetic material around said core such that when the stick has been finished, the product of said mass of said stick alone, in g, times the deflection of said stick alone, in mm, is 1000 mm.g at the most for a violin or viola bow, 700 mm.g at the most for a violoncello bow, and 600 mm.g at the most for a double-bass bow, and laying at least one layer of fiber-reinforced synthetic material around the head-side end of the stick proper so as to form said head before said at least two layers of fiber-reinforced material laid around said elongate core of said stick are cured, and curing, together, said at least one layer of fiber-reinforced synthetic material of said head and said at least two layers of fiber-reinforced material laid around said elongate core in a mould.

20. A method as set forth in claim 19, wherein said light-weight material of said elongate core is a foamed material.

21. A method as set forth in claim 19, wherein said light-weight material of said elongate core is balsa wood.

22. A method as set forth in claim 19, wherein said head of said stick comprises a head core of light-weight material and said at least one layer of fiber-reinforced synthetic material is laid around said head core when forming said head.

23. A method as set forth in claim 19, wherein a pre-fabricated synthetic material head insert is provided, further comprising pressing said at least one layer of fiber-reinforced synthetic material of said head against said pre-fabricated synthetic material head insert when said at least one layer of fiber-reinforced synthetic material of said head and said at least two layers of fiber-reinforced material laid around said elongate core together are laid into said mould for curing, said at least one fiber-reinforced synthetic material layer of said head being fixedly connected with said pre-fabricated synthetic material head insert during curing.

* * * * *